US005349129A

United States Patent [19]

Wisniewski et al.

[11] Patent Number: 5,349,129

[45] Date of Patent: Sep. 20, 1994

[54] ELECTRONIC SOUND GENERATING TOY

[75] Inventors: John M. Wisniewski, 1809 North Arlington Pl., Milwaukee, Wis. 53202; William W. Shier, Watertown, Wis.

[73] Assignee: John M. Wisniewski, Milwaukee, Wis.

[21] Appl. No.: 69,555

[22] Filed: May 28, 1993

[51] Int. Cl.[5] ..... G10H 1/34

[52] U.S. Cl. ..... 84/600; 84/718; 446/2; 446/397

[58] Field of Search ..... 84/600, DIG. 7, 718; 446/2, 130, 397; 434/156, 169, 185, 308

[56] References Cited

U.S. PATENT DOCUMENTS

| | | | |
|---|---|---|---|
| 4,651,611 | 3/1987 | Deforeit | 84/DIG. 7 |
| 4,676,134 | 6/1987 | Newell | 84/600 |
| 4,968,255 | 11/1990 | Lee et al. | 434/169 |
| 4,998,902 | 3/1991 | Garner et al. | 446/2 |

FOREIGN PATENT DOCUMENTS

| | | | |
|---|---|---|---|
| 2218689 | 4/1972 | Fed. Rep. of Germany | 446/2 |

OTHER PUBLICATIONS

Pressman Toy Corporation, New York, N.Y., 1993 Catalog entitled "Pressman 1993", pp. 2–3, published Feb.–Mar., 1993.

*Primary Examiner*—Stanley J. Witkowski
*Assistant Examiner*—H. Kim
*Attorney, Agent, or Firm*—Andrus, Sceales, Starke & Sawall

[57] ABSTRACT

The electronic device uses domino-shaped sound elements in combination with a support track to generate audible sounds or musical notes. The sound elements are placed in indentations on a support track in a selected sequence corresponding to the sequence of musical notes in a song to be played. Each of the sound elements corresponds to a single sound or musical note. When the sound elements are toppled in a domino-type manner, the notes are played in the selected sequence. Each of the sound elements has one or more magnetic elements in its bottom surface. The movement of the magnetic element away from associated Hall Effect sensors in the support track during toppling of the sound elements is used to trigger a decoding circuit. The decoding circuit determines the note pattern and generates the associated sound through an output speaker. A timbre sound element may also be used to select the timbre or other tonal characteristics of the output sounds.

9 Claims, 9 Drawing Sheets

FIG. 4
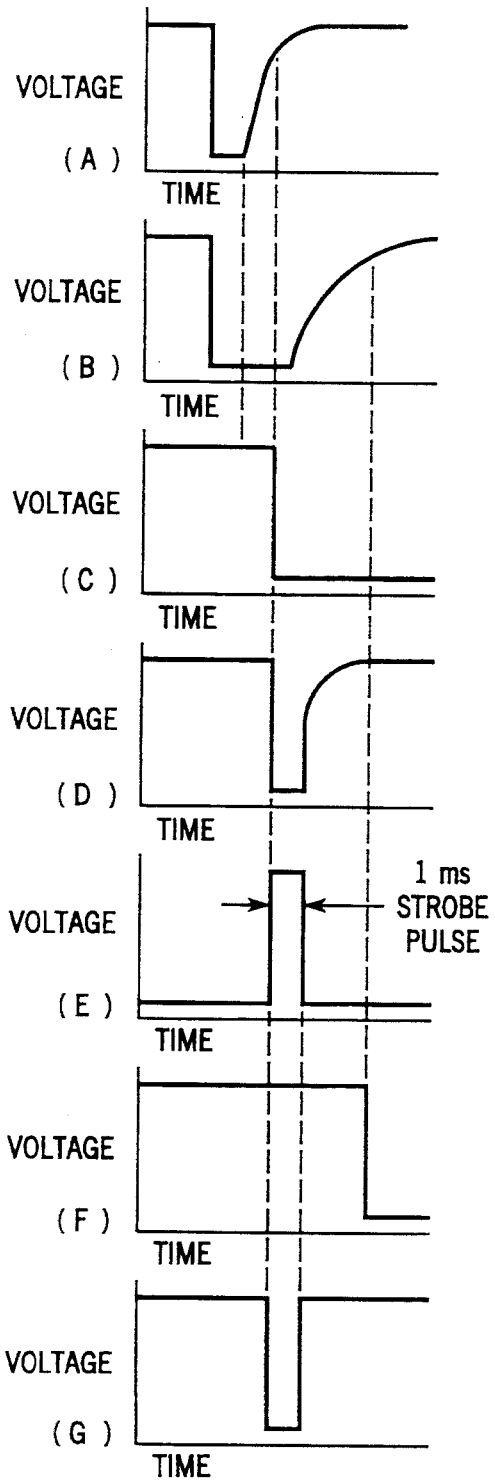
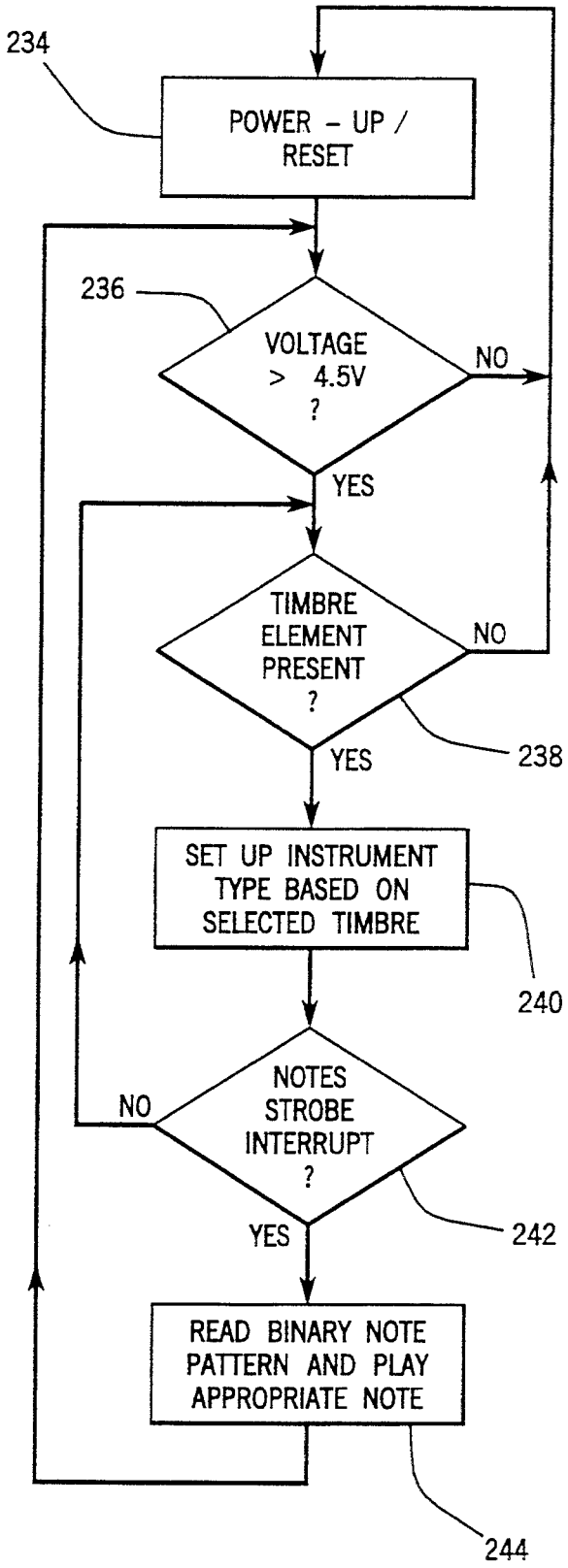
FIG. 7

ELECTRONIC SOUND GENERATING TOY

BACKGROUND OF THE INVENTION

This invention relates to electronic toys of the type which generate audible sounds, musical notes, tones and songs.

Toys are known which generate a preselected series of sounds or musical notes once the device is activated. Although such devices provide some amusement, they generally do not instruct the child in musical composition, nor are they changeable by the child.

Other musical toys such as toy pianos or xylophones are known which generate musical sounds. However, the child must typically learn the song and must strike the keys in a pre-selected manner corresponding to the song in order to generate the song. The striking of the keys at the appropriate time may be beyond the skill of young children.

Therefore, it is desirable to provide a musical toy that teaches children some basics of music, which allows many different songs to be played, and which is still within the skill of young children.

SUMMARY OF THE INVENTION

The sound generating device includes a support member having a plurality of successive sections, each of the sections having an indentation that is adapted to receive a domino-shaped sound element. The sound elements are placed in the indentations and are spaced on the support member. Each of the sound elements is associated with a specific sound or musical note. The distance between successive indentations is less than the length of each sound element, so that the sound elements may be toppled in a domino manner to play a succession of sounds or a musical song.

Each of the indentations in the support member has associated therewith a plurality of sensors that sense the movement of the sound element away from the particular indentation. In a preferred embodiment, the bottom of each sound element contains a plurality of magnetic components which uniquely identify the sound element with a particular musical note. Hall Effect sensors are disposed near the surface of the indentation, and sense the movement of the sound element away from the indentation when the sound element is toppled.

Also in a preferred embodiment, the support member comprises a linear track which is connectable to one or more other similarly-shaped support members. In this way, musical songs comprising many notes may be played by toppling the domino-shaped sound elements.

The sound generating device also includes a sound generating means for audibly generating the sounds associated with the sound elements. In one embodiment, the sound generating means includes a means for receiving an input signal from the sensing means when the sensing means determines that the sound elements have been moved away from the indentations in the support element, a means for thereafter generating a signal corresponding to the primary frequency of the sound, and a speaker that receives the generated signal and that outputs the first sound. In one embodiment, the signal generating means includes a plurality of oscillators that output a plurality of distinct frequency signals, and an analog selector that selects the frequency signal from the plurality of frequency signals which corresponds with the primary frequency of the selected sound.

In another embodiment, the signal generating means includes a microprocessor that generates a rectangular wave signal at the primary frequency, and a wave shaping means for converting the rectangular wave signal into a substantially sinusoidal waveform.

The preferred embodiment also includes a removable timbre element that is associated with a selected timbre of the sounds or musical notes.

The invention is particularly suitable for children because it is easy to use and does not require a great deal of manual dexterity to generate a musical song. Also, the invention teaches children about musical composition since each of the removable sound elements is preferably associated with a particular musical note, and must be placed in the proper sequence to generate the song. The invention also demonstrates to children that the same musical note may have different sounds, depending upon the selected timbre.

It is therefore a feature and advantage of the present invention to provide a musical toy which also serves as a music instructional device.

It is another feature and advantage of the present invention to provide a durable, self-contained musical toy that may play a wide variety of user-selected songs with no musical training.

These and other features and advantages of the present invention will be apparent to those skilled in the art from the following detailed description of the preferred embodiments and the drawings, in which:

BRIEF DESCRIPTION OF THE DRAWINGS

FIGS. 4A through 4G are timing diagrams relating to the sensing circuits of FIGS. 3A through 3H.

FIG. 7 is a flow chart of the software used to operate the microprocessor of FIG. 6.

DETAILED DESCRIPTION OF THE PREFERRED EMBODIMENTS

In a preferred embodiment of the present invention, the electronic device has a plurality of spaced domino-shaped sound elements placed in indentations in one or more linear support tracks. Each sound element corresponds to a single sound or musical The sequential placement of the sound elements corresponds to the notes in a song. Each of the sound elements may be marked with the note to which it corresponds, or may be color-coded to match the color code on sheet music.

It is to be understood, however, that the present invention may be used to generate other audible sounds besides musical notes and musical songs. For example, particular sound elements could be used to mimic animal sounds, the sounds of shooting guns, jet engines, or virtually any other electronically reproducible sound.

The sound elements as described below are totally removable from their support element or track. However, it is within the scope of the present invention to have the sound elements permanently hinged to the sound track so that they are readily replaced in an upright position after they have been toppled. Of course, other arrangements are also within the scope of the present invention, such as having the sound elements removably engagable with a hinged bracket.

Figure 1:
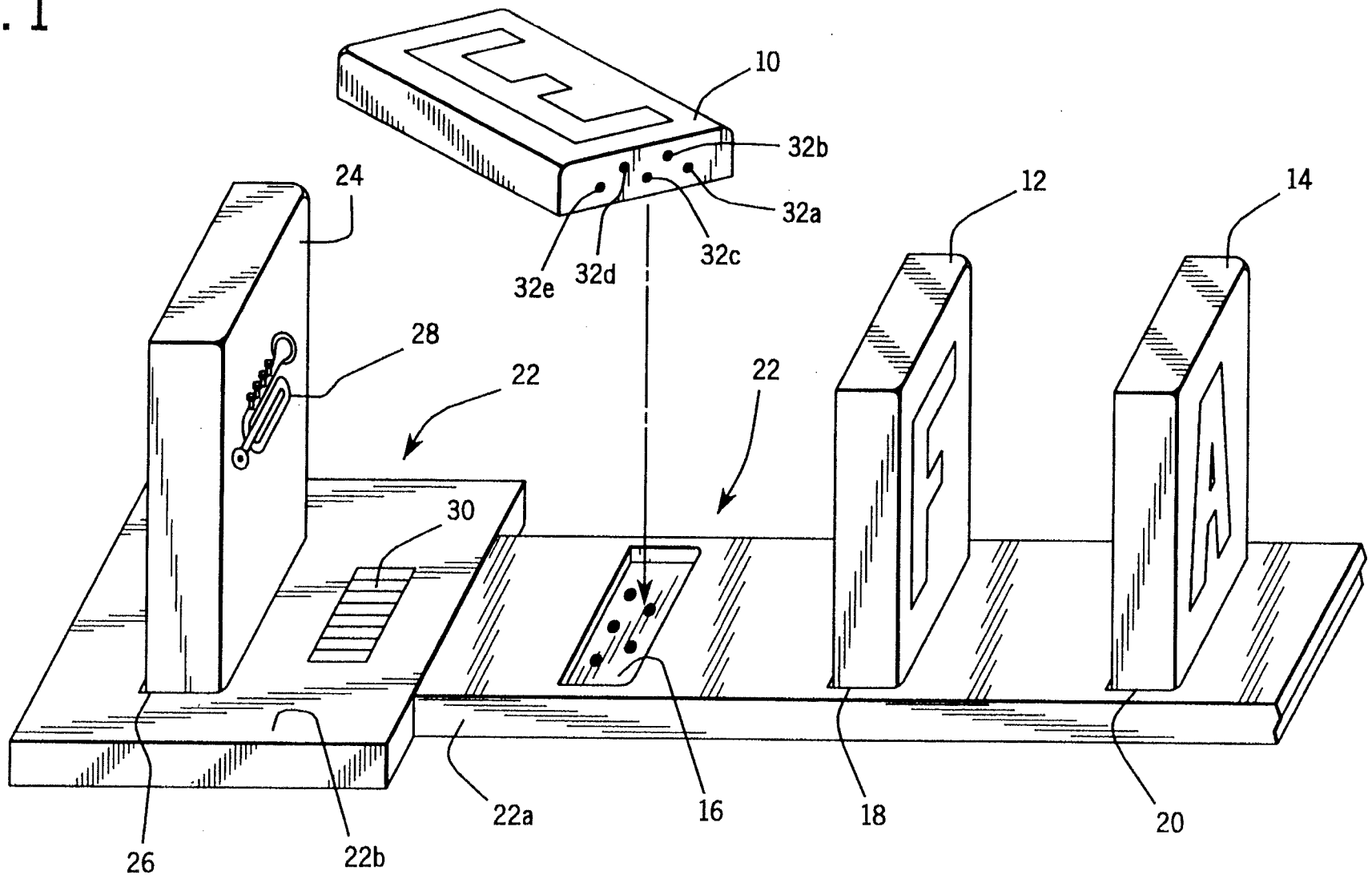
FIG. 1 is a perspective view of the electronic device having a single support track.

Referring to the preferred embodiment depicted in FIG. 1, a plurality of sound elements 10, 12 and 14 are disposed in respective indentations or recesses 16, 18 and 20 of a support element 22. Each of the sound elements preferably corresponds to a particular musical note or other audible sound. In FIG. 1, sound element 10 corresponds to an E note, sound element 12 corresponds to an F note, and sound element 14 corresponds to an A note.

Also placed in support element 22 is a timbre sound element 24 that is received in an indentation or recess 26 of support element 22. Timbre element 24 determines the tonal characteristics of sound elements 10 through 14. Where the sound elements are musical notes, the timbre element corresponds to the sound of a particular musical instrument, such as a horn 28. If the sound elements correspond to audible sounds other than musical notes, timbre element 24 may determine the pitch, volume, duration, or other characteristic of the individual sound elements.

Support element 22 encloses all of the electronics of the electronic device. Specifically, linear track 22*a* encloses the sensing circuitry described below, and section 22*b* encloses the sound generating circuitry as well as an output speaker 30.

The bottom surface of each sound element has a plurality of magnets disposed therein. In FIG. 1, each sound element has 1 to 5 magnets. Magnet 32*a* of sound element 10 is the first to be sensed by the sensing circuit associated with sound element 10. Strobe magnet 32*a* informs the sensor that a reading should be taken to determine whether the sound element is being moved and the particular note associated therewith. Each of the sound elements has a strobe magnet.

Other magnetic elements 32*b* through 32*e* are positioned so that they have corresponding Hall Effect sensors associated therewith. Magnets 32*b* through 32*e* determine the particular note or audible sound that is to be played by sound element 10. The presence or absence of a magnet in the positions of magnets 32*b* through 32*e* together create a four bit binary word. If a magnet is present in a particular position, the corresponding bit of the binary word becomes a "1" by using inverter logic. If a magnet is not present in the particular position, the bit in the binary word becomes a "0". In the example depicted in FIG. 1, the binary word corresponding to sound element 10 is 1111, or 16. Thus, the musical note E corresponds to the number 16. In this way, two full octaves of a musical scale, consisting of 16 notes, may be represented in the song. Of course, rests, quarter notes, half notes, etc. may all be encoded in this manner.

Figure 2:
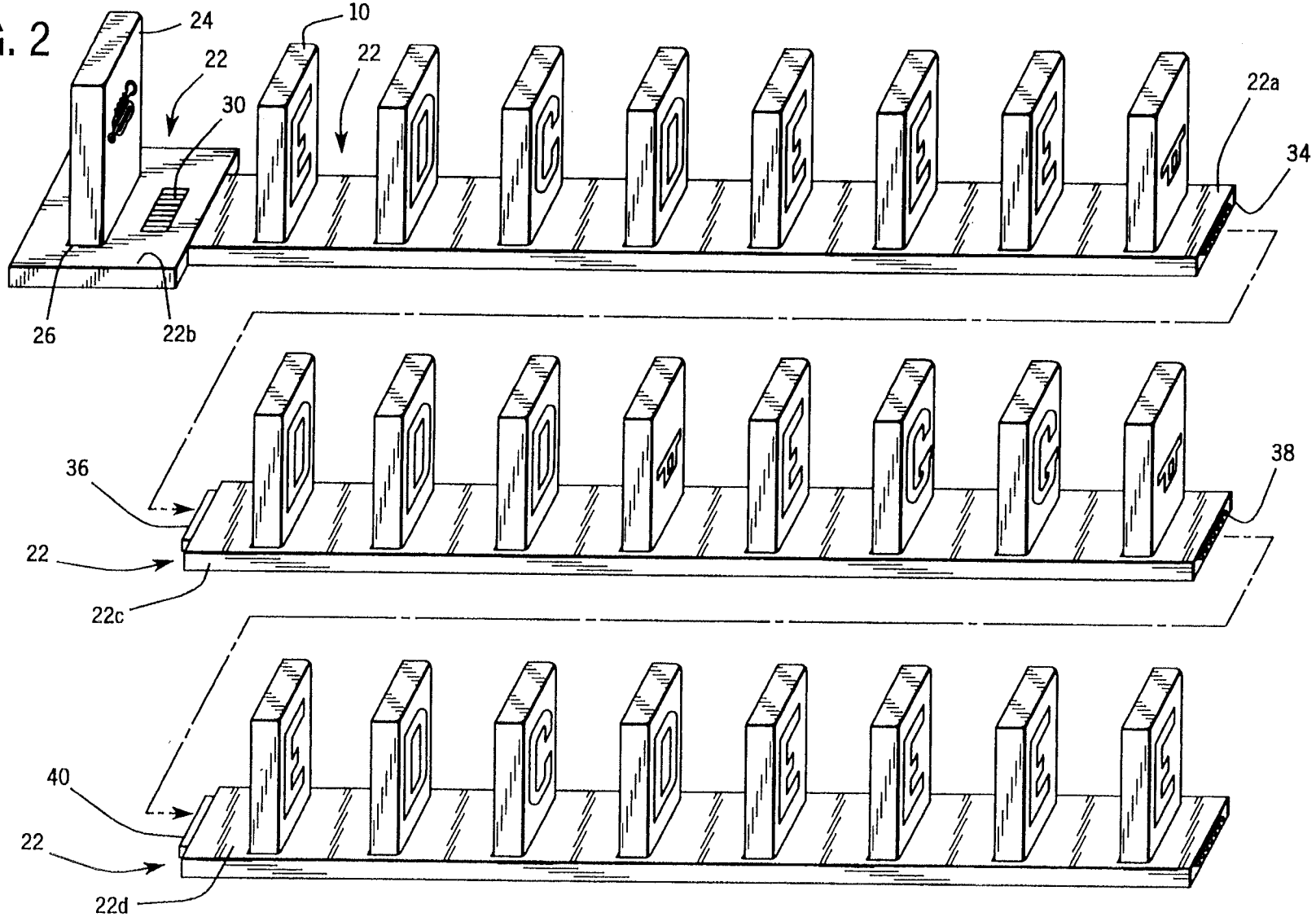
FIG. 2 is a perspective view of the electronic device having three interconnected support tracks.
Figure 3A:
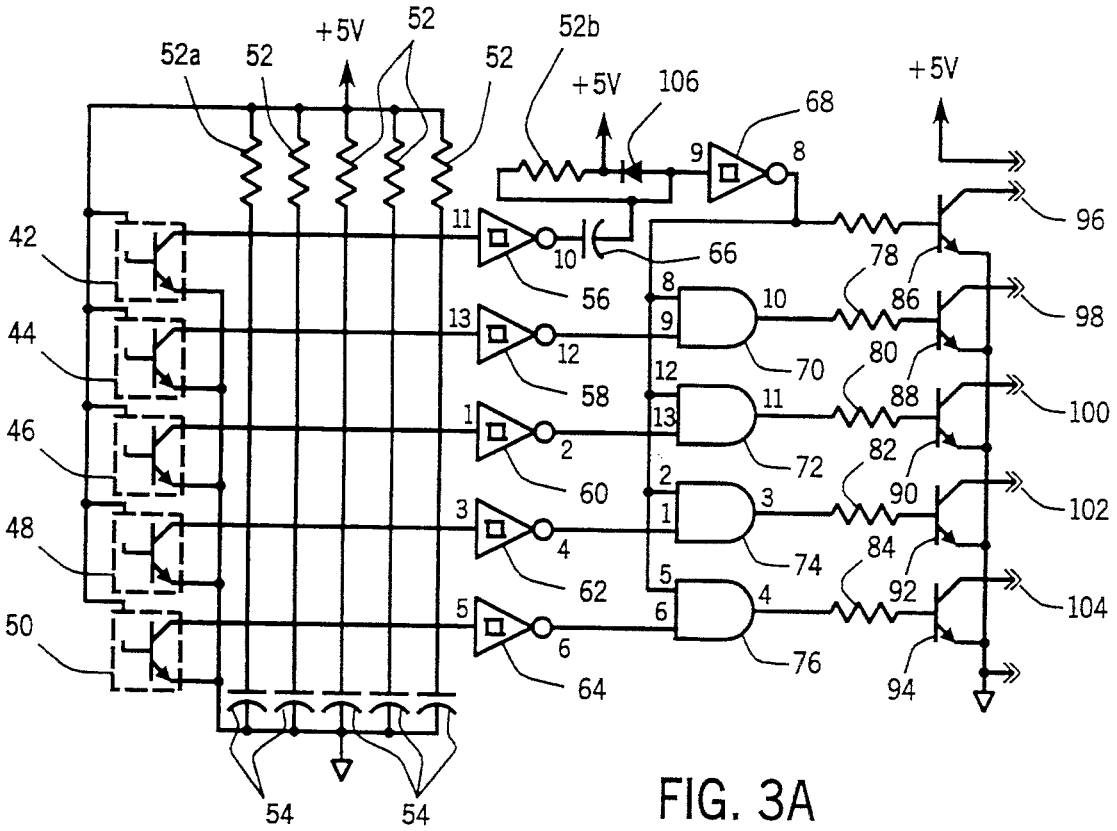
FIGS. 3A through 3H are schematic diagrams of the circuits which sense the removal of the associated sound elements.
Figure 3B:
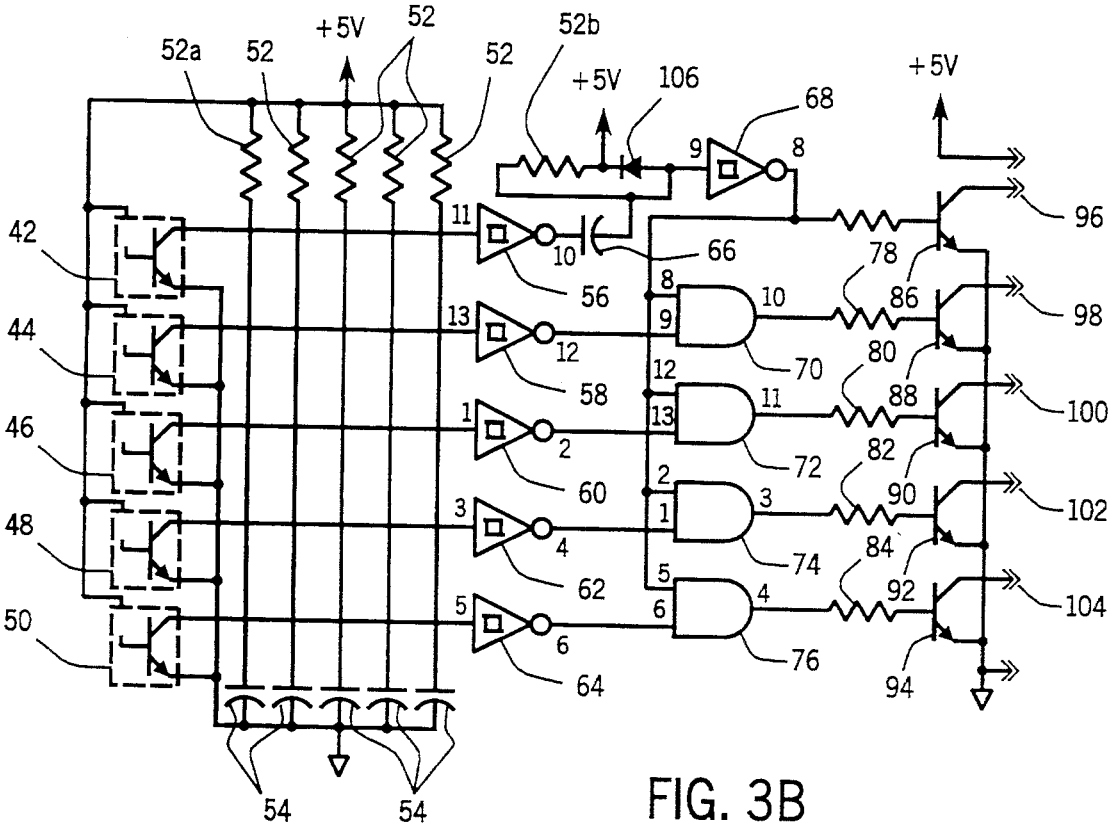
Figure 3C:
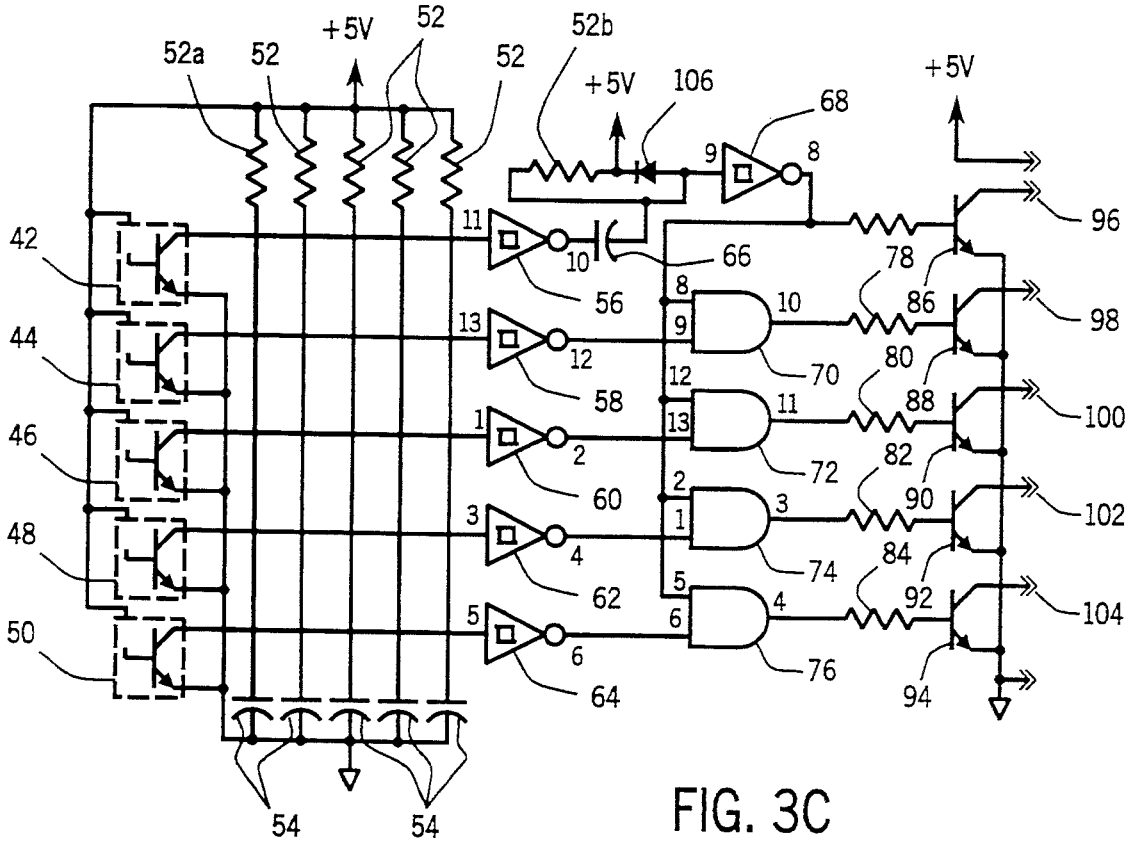
Figure 3D:
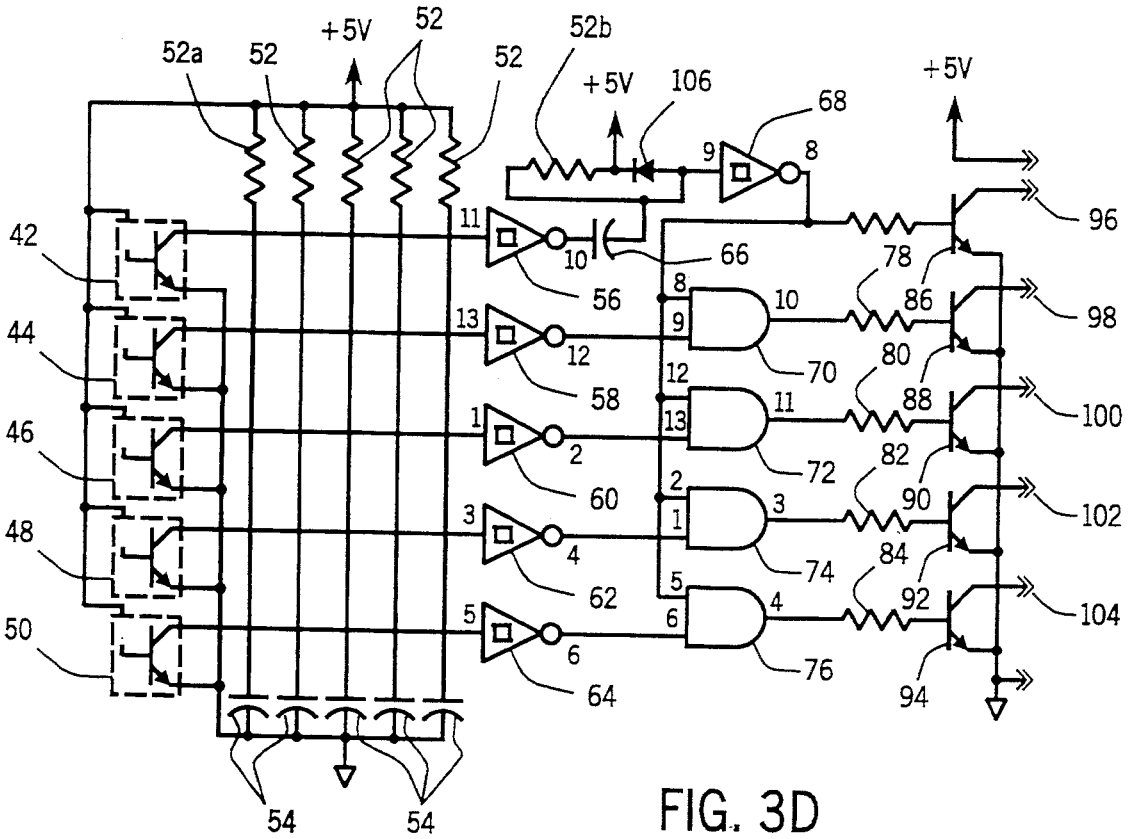
Figure 3E:
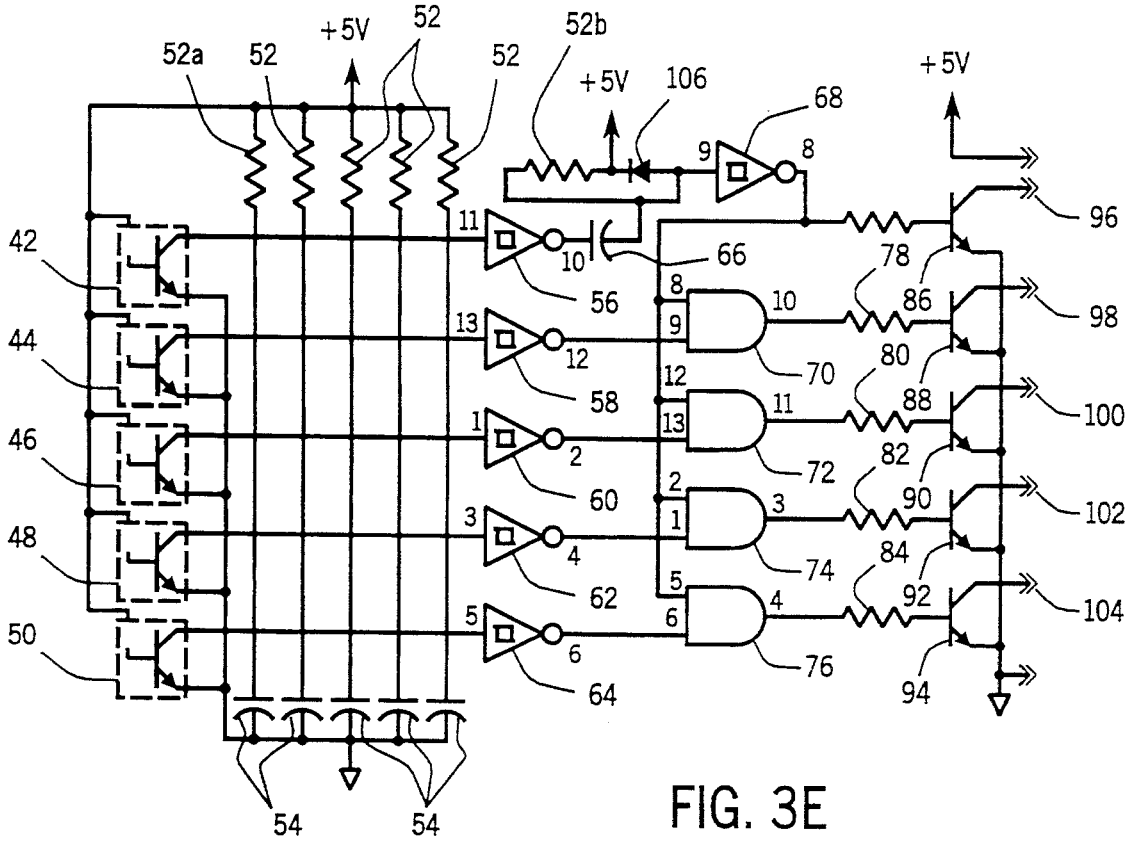
Figure 3F:
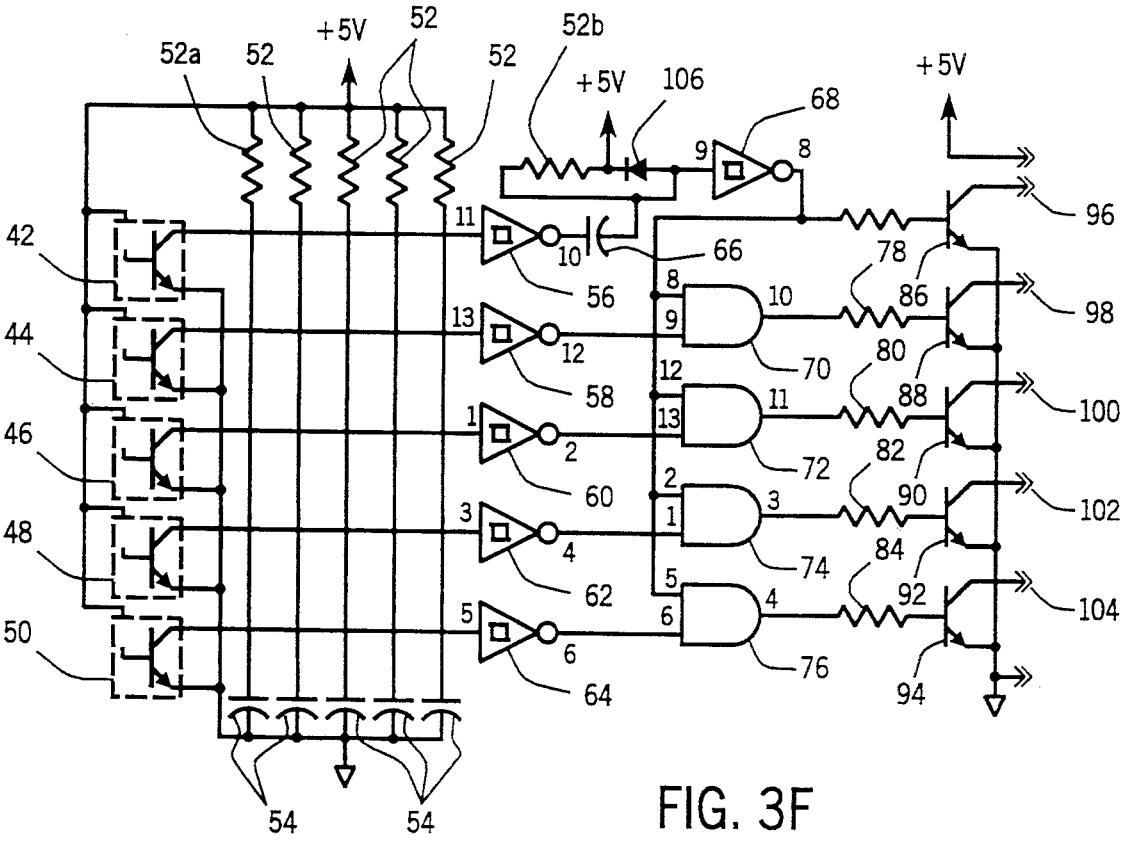
Figure 3G:
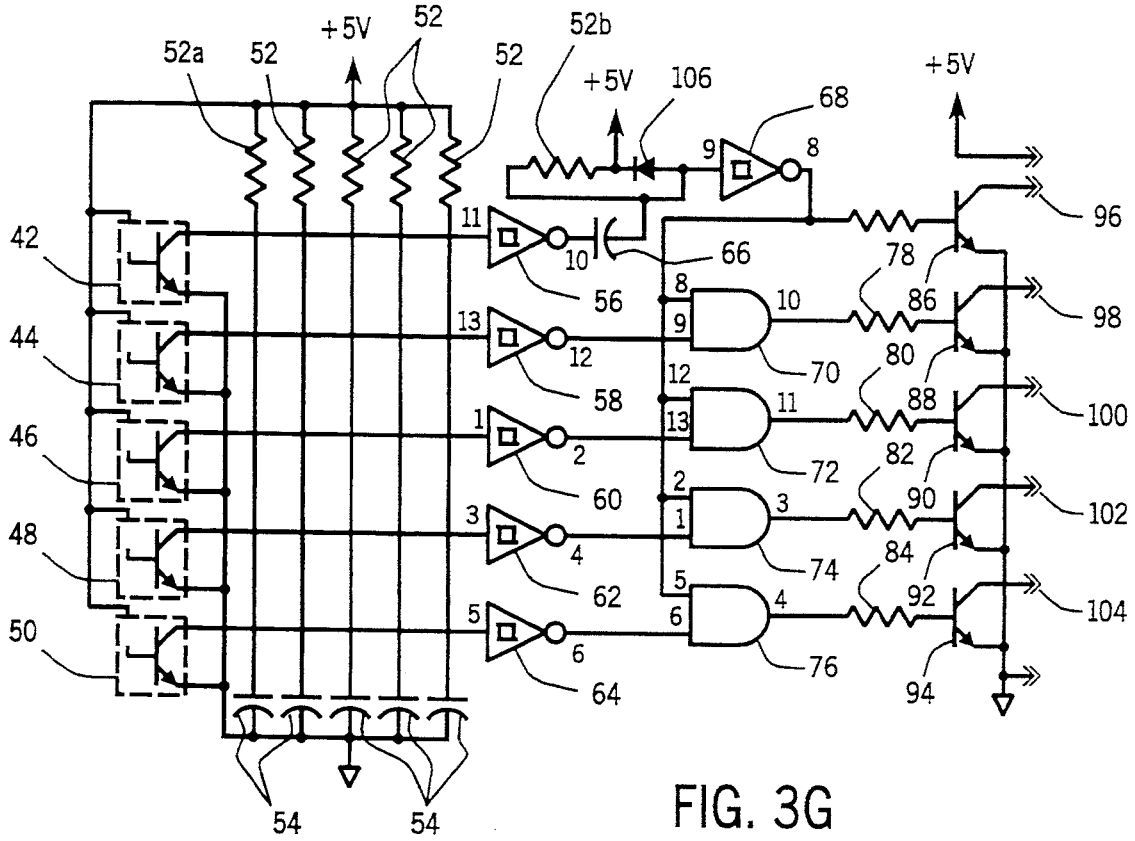
Figure 3H:
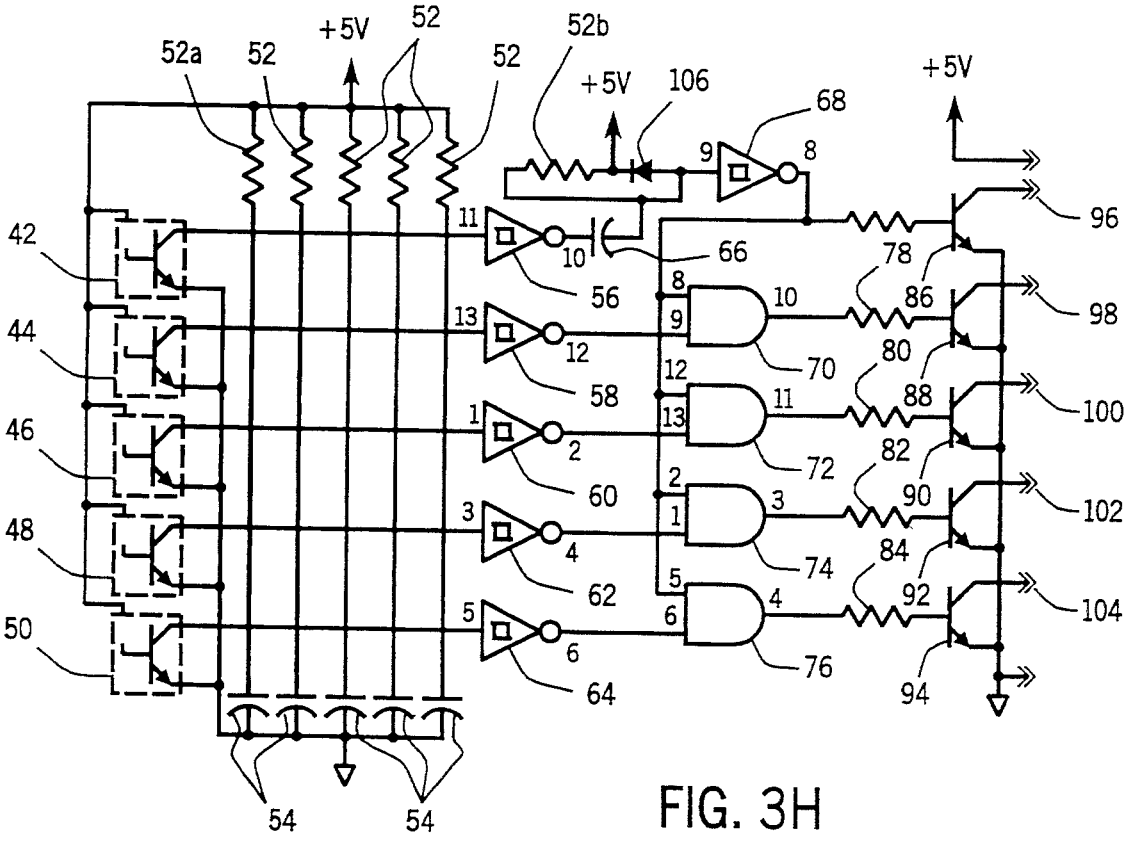

To play a complete musical song, it is desirable to interconnect a plurality of tracks 22 together in a linear fashion. The first sound element 10 is then toppled to cause the song to be played as a result of the domino-type toppling of the other sound elements. FIG. 2 depicts the connection of a plurality of support elements 22 in an end-to-end fashion. Track 22*a* is connected to track 22*c* by a seven pin plug-type connector 34 that is received in a corresponding seven pin receptacle-type connector 36 on track 22*c*. A seven pin connector is used since the bus has seven lines that interconnect each of the sensor circuits: four of the lines correspond to the four bits of the digital word; one line corresponds to the strobe signal; one line is the ground; and the last line is the power input Similarly, track 22*c* is connected by a seven pin plug-type connector 38 to a corresponding seven pin receptacle-type connector 40 disposed on track 22*d*.

As discussed above, each of the sound elements has a sensor that senses the movement of the sound element away from support element 22. These sensor circuits are all identical. Eight such sensor circuits are depicted in FIG. 3A through 3H. In FIGS. 3A through 3H, each sensor circuit includes Hall Effect sensors 42, 44, 46, 48 and 50. Sensors 42 correspond to the strobe sensor. Sensors 44 correspond to the least significant bit of the four bit binary word. Sensors 50 correspond to the most significant bit ("8") in the four bit binary word. Resistors 52 and capacitors 54 together form an RC timing circuit that hold the output signal from Hall Effect sensors 42 through 50 for a short time after the associated sound element actually falls. Capacitors 54 begin charging after the sound element falls, thereby retaining the output signal until the strobe is completed. The RC network preferably has a 4.7 millisecond time constant. The RC circuit for strobe sensor 42 has a shorter time constant.

Each of the Hall Effect sensors is connected to its respective Schmitt trigger inverter 56, 58, 60, 62, and 64. The output of inverter 56 is connected via a capacitor 64 to the input of Schmitt trigger inverter 68. The output of inverter 68 is connected as an input to each of AND gates 70, 72, 74, and 76. The other input to AND gates 70, 72, 74 and 76 is connected to the output of inverters 58, 60, 62 and 64 respectively. The output of AND gates 70, 72, 74 and 76 are connected through resistors 78, 80, 82, and 84 to the bases of transistor switches 88, 90, 92 and 94.

Each of the sensors is FIG. 3A through 3H operates in the following manner. Hall Effect sensors 42 through 50 are in their static ON state whenever a magnet corresponding thereto has been sensed. However, no signal is output on bus lines 96, 98, 100, 102 and 104 until the circuits are enabled by a strobe pulse.

When the movement of a sound element is sensed, strobes sensor 42 is turned OFF, and its associated capacitor charges. At the same time, any of the other sensors which had been turned ON due to the presence of an associated magnet are also turned OFF, and their associated capacitor is also charged. When the capacitor associated with the strobe sensor gets charged, a logical "1" signal is applied to the input of inverter 56, which is inverted to a logical "0" at its output. This output is fed to the AC coupled circuit, consisting of diode 106, capacitor 66, resistor 52*b* and inverter 68. Inverter 68 outputs a logical "1" signal while capacitor 66, associated with strobe inverter 36, is charging. The momentary high output from inverter 68 is applied as one of the inputs to AND gates 70 through 76.

At the same time, the inputs to inverters 58 through 64 remain low during the charging of their associated RC time constant circuit after their sensors 44 through 50 are turned OFF. These logical "0" signals are inverted by inverters 58 through 64 so that a logical "1" is applied to one or more of AND gates 70 through 76. With the presence of the strobe signal, the output of the AND gates corresponding to the selected note go high, thereby turning ON transistor switches 86 through 94. When the transistors are turned ON, signals are applied to their bus lines. As indicated above, each of the strobe outputs is connected to a single bus line. Also, each of the other bits of the digital word is connected to the sensors of the same bit in each of the other sensor circuits. That is, each of the least significant bits is connected together via the same bus line, each of the most significant bits is connected via the same bus line, and so on.

FIGS. 4A through 4G are timing diagrams corresponding to the circuits of FIGS. 3A through 3H. In FIGS. 4A through 4G, the signal in FIG. 4A corresponds to the output of strobe sensor 42. The signal in FIG. 4B corresponds to the output of sensors 44, 46, 48 and 50. The signal in FIG. 4C corresponds to the output of inverter 56. The signal in FIG. 4D corresponds to the signal input to inverter 68 after the sound element has been toppled. The signal in FIG. 4E corresponds to the output of inverter 68. The signal in FIG. 4F corresponds to the output of inverters 58, 60, 62 and 64. Finally, the signal in FIG. 4G corresponds to the signal on strobe bus 96 and each of buses 98–104 where a magnet was present.

Figure 5:
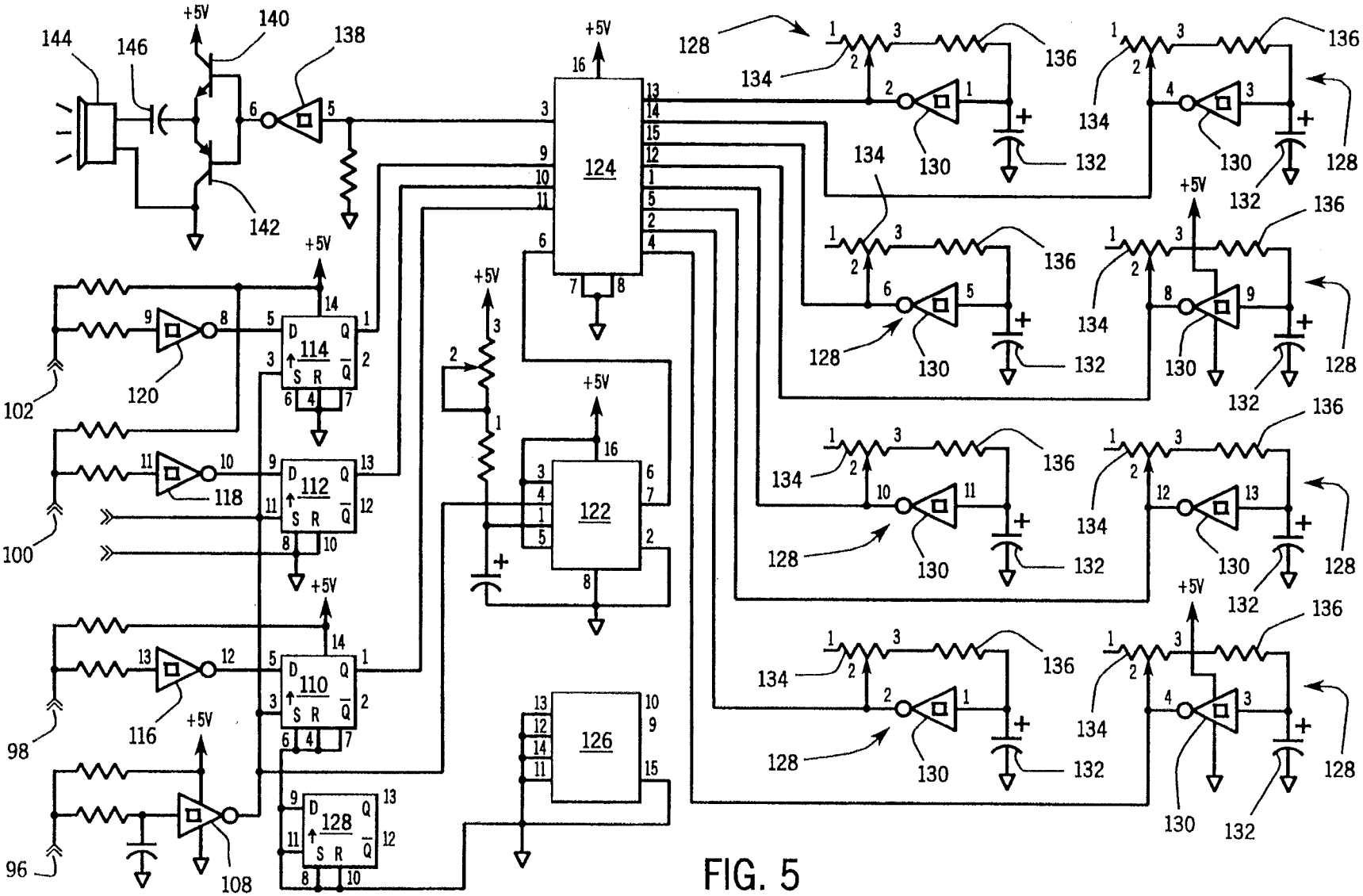
FIG. 5 is a schematic diagram of an analog sound generating circuit that may be used with the present invention.

FIG. 5 is a schematic diagram of an analog sound generating circuit that may be used in the present invention, and particularly with the sensing circuits of FIG. 3A through 3H. For the sake of simplicity, however, the circuit in FIG. 5 has been limited to a circuit that will only generate eight different audible sounds or musical notes. It is well within the scope of the ordinary person skilled in the art to expand the circuit of FIG. 5 to permit the generation of 16 or more audible sounds.

In FIG. 5, the strobe signal present on bus 96 latches the note pattern present on buses 98, 100 and 102 into a set of D-type latches 110, 112, and 114 respectively. Each of the note pattern signals is first inverted via inverters 116, 118, and 120 respectively. The inverted strobe signal also triggers a 1-shot timer 122, which instructs an analog 1 of 8 selector 124 as to the length of time that each sound is to be passed through to the speaker.

Selector chip 124 has connected thereto eight oscillator circuits 128. Each of the oscillator circuits includes a Schmitt trigger inverter 130, a capacitor 132, and resistors 134 and 136. Each of oscillators 128 outputs a different frequency, corresponding to a primary frequency of an audible sound or musical note. Selector 124, in response to the input note pattern, selects one of the oscillating frequencies and outputs a signal corresponding thereto at pin 3. This output signal is inverted by inverter 138, which drives a pair of transistors 140 and 142 connected in a push-pull manner. Transistors 140 and 142 in turn drive output speaker 144 through a capacitor 146 to produce the audible sounds.

Figure 6:
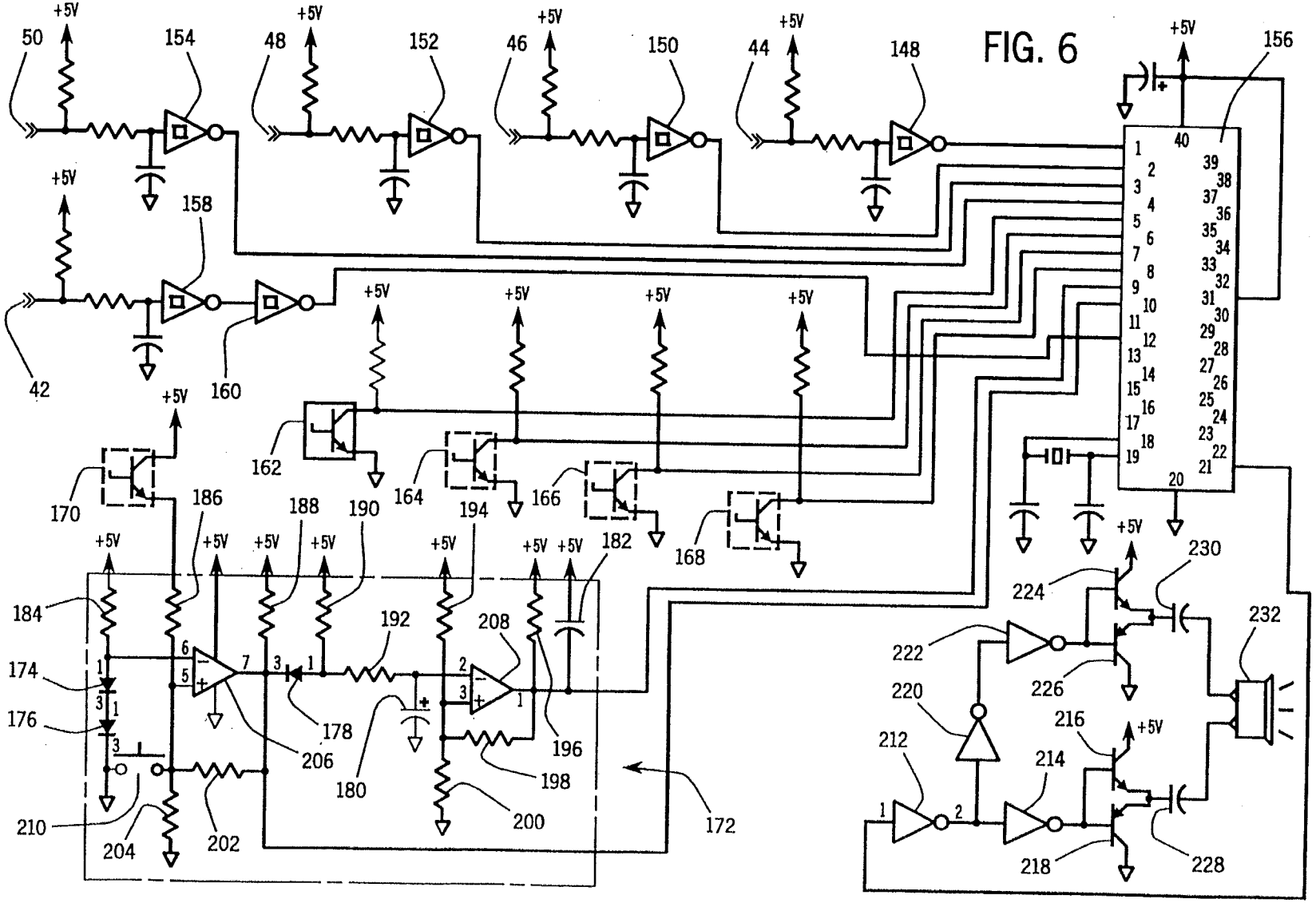
FIG. 6 is a schematic diagram of a microprocessor-based sound generating circuit that may be used with the present invention.

FIG. 6 depicts an alternate, microprocessor-based circuit for generating the audible sounds. In FIG. 6, the sounds are sent via buses 44, 46, 48 and 50 as inputs to inverters 148, 150, 152 and 154 respectively. The inverted signals are applied to pins 1 through 4 of microprocessor 156. The strobe signal is sent by bus 42 to the input of an inverter 158, whose output is connected as an input to inverter 160. The output of inverter 160 is applied to the interrupt input (pin 12) of microprocessor 156.

Hall Effect sensors 162, 164, 166 and 168 cooperate with magnets on the bottom of the timbre sound element to select the timbre, or tonal characteristics of the output audible sounds. The outputs of sensors 162 through 168 are applied to pins 5 through 8 respectively of microprocessor 156. Hall Effect sensor 170 senses the presence of a magnet on the bottom of a power enable block element that may be placed on the support track. The power enable block element avoids the need for a separate Power On switch.

Circuit 172 resets microprocessor 156 based upon a voltage trigger point in the event that the voltage output of a battery power supply decreases to a threshold level, such as 4.5 VDC. Circuit 172 automatically holds microprocessor 156 in the reset condition, to prevent microprocessor 156 from operating in the event that inadequate power exists. Circuit 172 includes diodes 174, 176 and 178, capacitors 180 and 182, resistors 184 through 204, operational amplifiers 206 and 208, and a switch 210.

Based upon the input sound, microprocessor 156 outputs a rectangular waveform corresponding to the selected frequency at pin 21. A pair of inverters 212 and 214 control a pair of transistors 216 and 218. A second pair of inverters 220 and 222 control a pair of transistor switches 224 and 226. The outputs of the transistor pairs are complementary square waves. Capacitors 228 and 230 filter the square waves to make them substantially sinusoidal. The two complementary waveforms are applied to the inputs of a speaker 232, and have the effect of doubling the volume output of speaker 232.

FIG. 7 is a flow chart of the software used to operate microprocessor 156. In FIG. 7, the program begins at Step 234 by powering up or resetting the microprocessor. At Step 236, a determination is made whether the voltage supplied to the microprocessor is greater than the threshold voltage of 4.5 volts. If not, the microprocessor resets at Step 234, as discussed above in connection with FIG. 6.

If the answer is YES at Step 236, a determination is made at Step 238 whether the timbre sound element is present. If the timbre element is not present, the program loops back to Step 234. If the timbre element is present, the electronic device is set up at Step 240 based upon the selected timbre. At Step 242, a determination is made whether the strobe signal has been received. If the strobe signal has not been received, the program loops back to determine whether the timbre element is present. If a strobe signal has been received, the binary sound pattern is read at Step 244 and the appropriate sound is output. The program then returns to Start.

Although several embodiments of the present invention have been shown and described, other embodiments will be apparent to those skilled in the art and are within the intended scope of the present invention. Therefore, the invention is to be limited only by the following claims.

We claim:

1. An electronic device that generates a plurality of audible sounds in a selected sequence, comprising:

a plurality of sound elements, each sound element corresponding to an audible sound, and each of said sound elements having an upper end and a lower end, the distance between said upper ends and said respective lower ends defining a length of each of said sound elements;

a first support member having a plurality of spaced areas, each of said areas receiving one of said sound elements, and wherein the distance between two adjacent spaced areas is less than the length of one of the sound elements received on one of said adjacent spaced areas, so that the sound elements may be successively moved in a domino manner, and wherein each of said spaced areas includes a sensor that senses whether the sound element received by that spaced area is being moved away from said spaced area; and sound generating means for generating said audible sounds in said selected sequence, said selected sequence corresponding to the order in which said sound elements are moved away from their respective spaced areas.

2. The device of claim 1, wherein said sound generating means includes:

means for receiving an input signal from each of said sensors when said sensors sense that the sound elements received by the spaced areas associated with the sensors have been moved;

means for thereafter generating signals corresponding to the primary freguencies of each of the audible sounds associated with said moved sound elements; and a speaker that receives said generated signals and that outputs the audible sounds associated with said moved sound elements.

3. The device of claim 2, wherein said signal generating means includes:

a plurality of oscillators that output a plurality of distinct frequency signals; and a selector that selects the frequency signal from said plurality of frequency signals corresponding to each of said primary frequencies.

4. The device of claim 2, wherein said signal generating means includes:

a microprocessor that generates wave signals at each of said primary frequencies; and waveshaping means for converting said wave signals into substantially sinusoidal waveforms.

5. The electronic device of claim 1, wherein each of said audible sounds is a musical note, and wherein said selected sequence of audible sounds comprises a song.

6. The electronic device of claim 1, wherein each of said sound elements includes at least one magnet, and wherein each of said sensors includes a Hall Effect sensor.

7. The electronic device of claim 1, wherein each of said spaced areas includes an indentation that receives the respective lower end of one of said sound elements.

8. The electronic device of claim 1, further comprising:

a second support member having a second plurality of spaced areas, each of said second plurality of spaced areas receiving a sound element, and each of said second plurality of spaced areas also including a sensor that senses whether the sound element received by said spaced area of said second plurality of spaced areas is being moved away from said spaced area of said second plurality of spaced areas; and means for electrically connecting said second support member to said first support member.

9. The electronic music device of claim 1, further comprises:

a timbre element having a timbre element end that is received by said support element, said timbre element determining the tonal characteristics of said audible sounds.

* * * * *

UNITED STATES PATENT AND TRADEMARK OFFICE

CERTIFICATE OF CORRECTION

PATENT NO. : 5,349,129

DATED : September 20, 1994

INVENTOR(S) : John M. Wisniewski et al

It is certified that error appears in the above-indentified patent and that said Letters Patent is hereby corrected as shown below:

CLAIM 2, Col. 7, Line 19, delete "freguencies" and substitute therefor ---frequencies---; CLAIM 9, Col. 8, Line 31, delete "element" and substitute therefor ---member---.

Signed and Sealed this

Twenty-fourth Day of January, 1995

*Attest:*

Bruce Lehman

BRUCE LEHMAN

*Attesting Officer*

*Commissioner of Patents and Trademarks*